US005449048A

United States Patent [19]

Thigpen et al.

[11] Patent Number: 5,449,048

[45] Date of Patent: Sep. 12, 1995

[54] DRILL BIT HAVING CHIP BREAKER POLYCRYSTALLINE DIAMOND COMPACT AND HARD METAL INSERT AT GAUGE SURFACE

[75] Inventors: Gary M. Thigpen, Houston; William H. Sherwood, Jr., Spring; Coy M. Fielder, Cypress, all of Tex.

[73] Assignee: Baroid Technology, Inc., Houston, Tex.

[21] Appl. No.: 312,260

[22] Filed: Sep. 26, 1994

Related U.S. Application Data

[62] Division of Ser. No. 996,151, Dec. 23, 1992, abandoned.

[51] Int. Cl.[6] ..... E21B 10/46

[52] U.S. Cl. ..... 175/430

[58] Field of Search ..... 175/426, 428, 430, 431, 175/432; 407/61, 62, 100, 116, 119

[56] References Cited

U.S. PATENT DOCUMENTS

| | | | |
|---|---|---|---|
| Re. 32,036 | 11/1985 | Dennis | 175/429 |
| 4,606,418 | 8/1986 | Thompson | 175/429 |
| 4,640,375 | 2/1987 | Barr et al. | 175/431 |
| 4,852,671 | 8/1989 | Southland | 175/430 |
| 4,872,520 | 10/1989 | Nelson | 175/430 |
| 4,984,642 | 1/1991 | Renard et al. | 175/430 |
| 4,997,049 | 3/1991 | Tank et al. | 407/119 X |
| 5,078,219 | 1/1992 | Morrell et al. | 175/427 |

FOREIGN PATENT DOCUMENTS

| | | |
|---|---|---|
| 0572761 | 8/1993 | European Pat. Off. . |
| 2152104 | 7/1985 | United Kingdom . |
| 2276645 | 10/1994 | United Kingdom . |

*Primary Examiner*—Hoang C. Dang

*Attorney, Agent, or Firm*—Browning, Bushman, Anderson & Brookhart

[57] ABSTRACT

A drag bit having a plurality of blades or ribs on its end face has one or more pockets milled into the top surfaces of said blades using a ball-nosed end mill to create a plurality of pockets, each having a spherical or a semi-spherical first end and a second end having a semicircular configuration that intersects with the leading edge face of the rib. A bullet-shaped cutting structure having a spherical first end is brazed into each of the pockets. During the manufacturing process, a pin is brazed into cooperating first and second semicircular receptacles in the spherical end of the cutter and in the semi-spherical end of the pocket, respectively, to prevent the cutter assembly from being pushed up out of the pocket during the drilling operation. In an alternative embodiment, a slot is milled into the top surface of the rib to allow use of a ball-nosed end mill having a reduced diameter shank sized to pass through the slot. In yet another embodiment, a tungsten carbide button or insert is position at the gauge diameter to reduce impact on the gauge diameter cutter in each of the ribs. Cutter assemblies are disclosed having a variety of orifices in the PDC cutter face to function as chip breakers during the drilling operation.

5 Claims, 8 Drawing Sheets

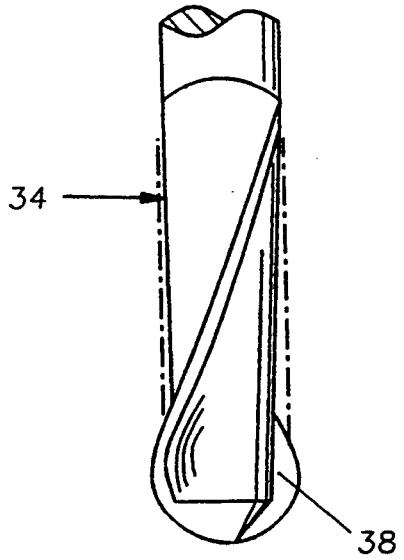
FIG. 11
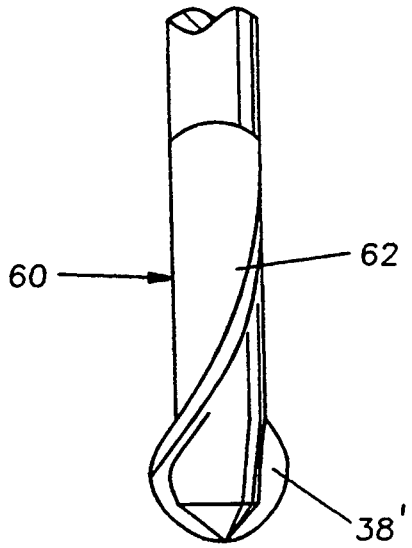
FIG. 12
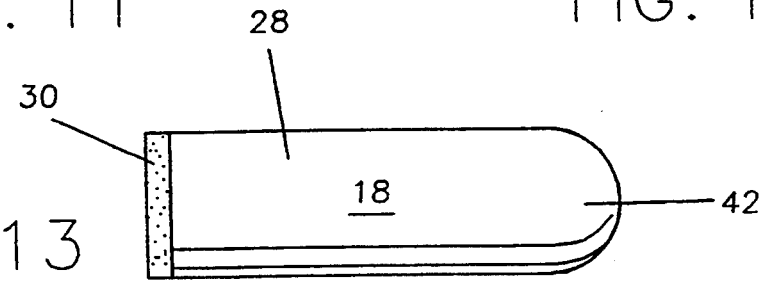
FIG. 13
FIG. 14
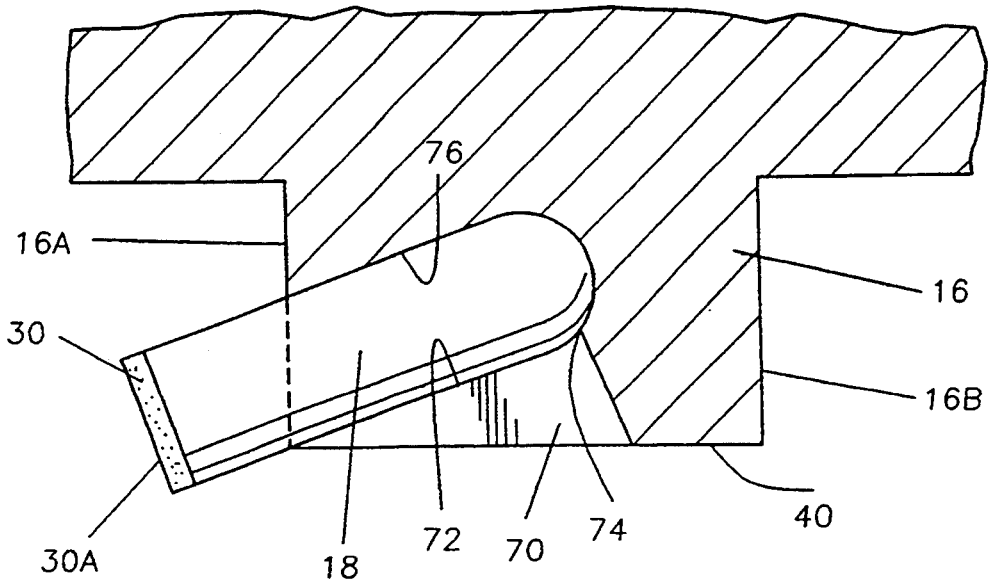

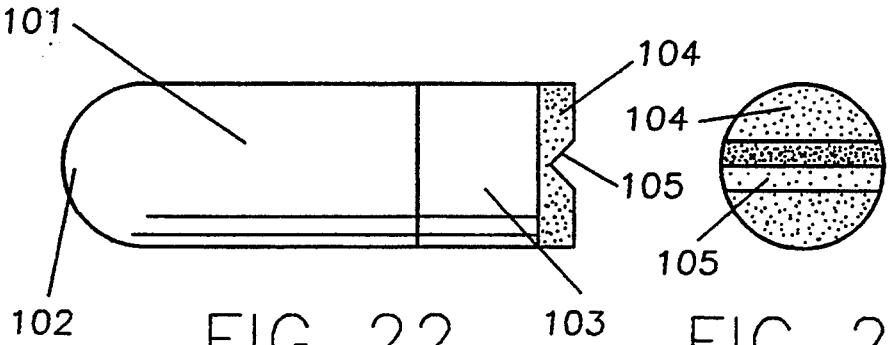
FIG. 22
FIG. 23
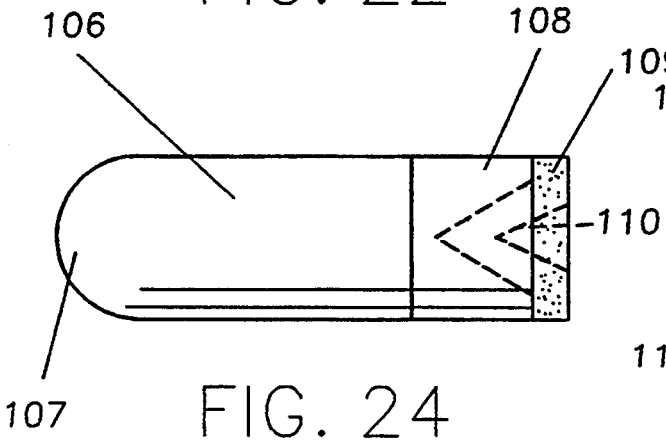
FIG. 24
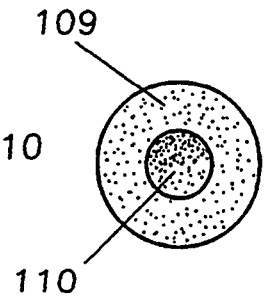
FIG. 25
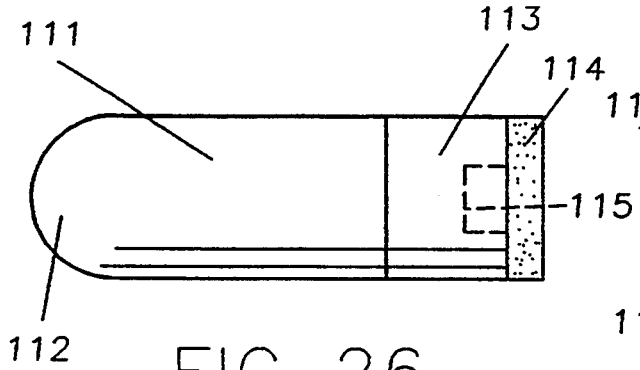
FIG. 26
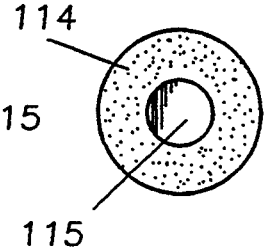
FIG. 27
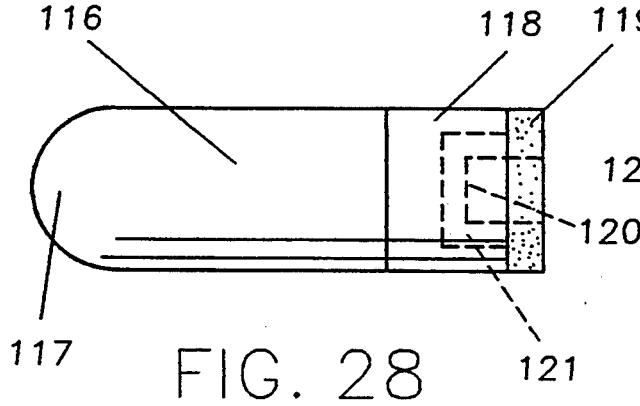
FIG. 28
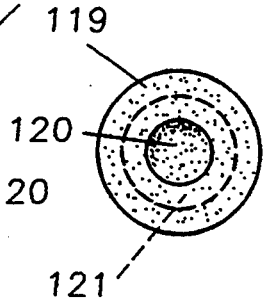
FIG. 29

FIG. 30
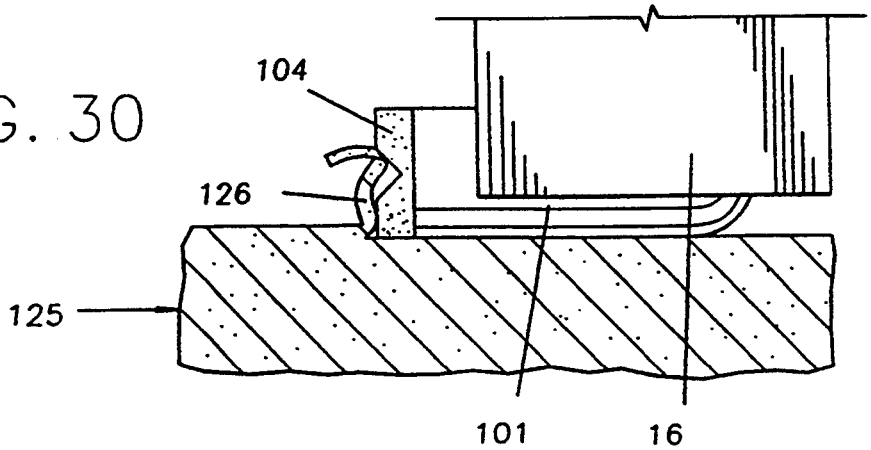
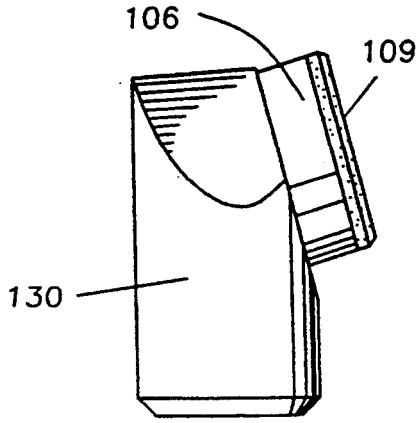
FIG. 31
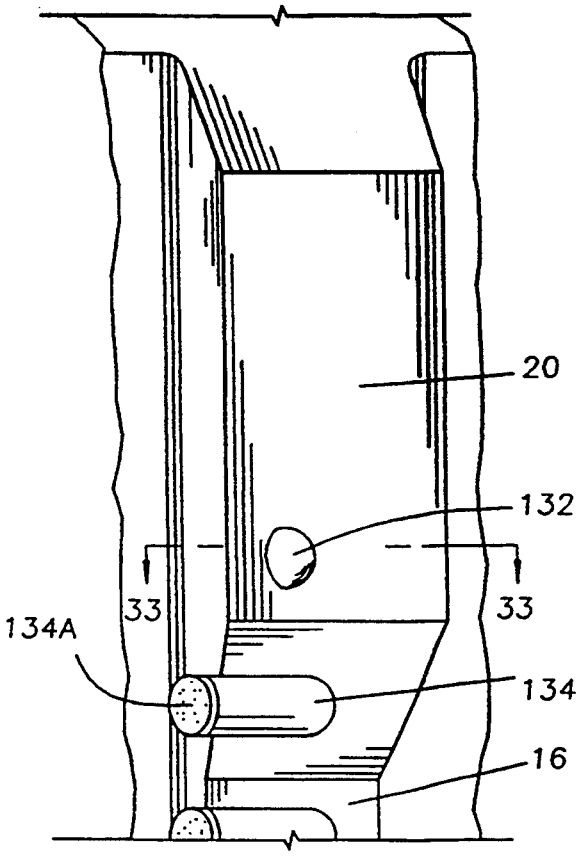
FIG. 32
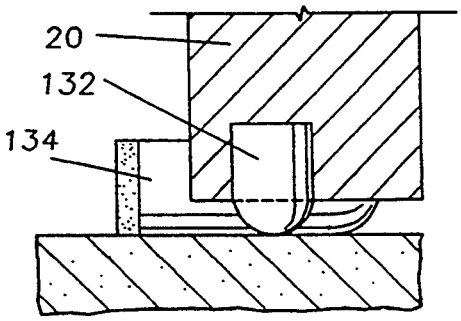
FIG. 33

DRILL BIT HAVING CHIP BREAKER POLYCRYSTALLINE DIAMOND COMPACT AND HARD METAL INSERT AT GAUGE SURFACE

This application is a divisional application of U.S. application Ser. No. 07/996,151 filed Dec. 23, 1992 now abandoned.

BACKGROUND OF THE INVENTION

1. Field of the Invention

The present invention relates, generally, to drill bits used for the drilling of oil and gas wells, and also relates to methods for manufacturing such drill bits. Such bits are used in drilling earth formations in connection with oil and gas exploration and production.

2. Description of the Prior Art

It is well known in prior art drill bits to use cutting elements having on one end thereof a polycrystalline diamond compact, generate referred to as a "PDC." The PDC material is typically supplied in the form of a relatively thin layer on one face of a substantially larger mounting body. The mounting body is usually a stud-like end configuration and typically is formed of a relatively hard material such as sintered tungsten carbide. The diamond layer may be mounted directly on the stud-like mounting body, or it may be mounted via an intermediate disc-like carrier, also typically comprised of sintered tungsten carbide. In any event, the diamond layer is typically disposed at one end of the stud-like mounting body, the other end of which is mounted in a bore or recessed in the body of the drilling bit.

The bit body itself is typically comprised of one of two materials. The body is either a tungsten carbide matrix or is made of various forms of steel. When the body is made of steel, the pocket for receiving the stud is usually in the shape of a cylinder to receive the cylindrically shaped stud of the cutter.

It has been well known in this art that when the bit body is comprised of a tungsten carbide matrix, the pockets can be formed in whatever shape is desirable. For example, in U.S. Pat. No. 4,200,159 to Eberhard Peschel et at., there is disclosure that the cutter body can be in the form of a cylinder as illustrated in FIG. 7 of that patent or can be in the form of a pin (see FIG. 14) or in the form of a cone as illustrated in FIGS. 15 and 16 of U.S. Pat. No. 4,200,159.

When using a so-called blade cutter, those in the art of steel bodied bits have usually machined the cylindrical pockets from the front of the blade, thereby limiting access to the center of the bit.

We have discovered that by using a PDC cutter having a center cylindrical section and a spherical section on one end away from the PDC cutter end, thus essentially being in the shape of a bullet, the cutter can be placed in a pocket conforming, at least in part, to the spherical end of the cutter. We are thus able to provide cutter locations in the center of the bit that have not been previously available to those in the art.

SUMMARY OF THE INVENTION

The objects of the invention are accomplished, generally, by the provision of a new and improved drag bit for drilling oil and gas wells, comprising:

a hard metal body having an end face, said end face defining a plurality of upsets each having a top surface and a leading edge surface, each of said upsets having a plurality of polycrystalline diamond compact cutter assemblies mounted therein, each of said upsets commencing near the center of said end face and terminating at the gauge diameter of said bit and being spaced peripherally around said gauge diameter, said bit being characterized by the addition of a hard metal insert in the gauge diameter, top surface portion of each of said upsets to thereby lessen impact to the cutter assembly nearest each said tungsten carbide insert, respectively.

Another feature of the invention involves a cutting structure comprising:

a tungsten carbide carrier body for mounting in said drag bit;

a polycrystalline diamond compact layer mounted on said carrier, said layer having a receptacle therein for breaking chips during the drilling operation.

BRIEF DESCRIPTION OF DRAWINGS

FIG. 11 is a pictorial view of a ball nosed end mill used in the manufacturing process in accord with the present invention;

FIG. 12 is an alternative ball nosed end mill having a reduced shank that is sized to pass through the slot illustrated in FIGS. 7–10;

FIG. 13 is a pictorial view of a bullet-shaped cutter in accord with the present invention;

FIG. 14 is an elevated view of an alternative embodiment of the present invention in which the cutter is brazed into place in a pocket angled away from the top surface of the rib in accord with the present invention;

FIG. 22 is a pictorial view of a bullet-shaped cutter in accord with the present invention having an alternative embodiment of the invention, including a non-planar cutter face;

FIG. 23 is an end view of the cutter illustrated in FIG. 22;

FIG. 24 is an alternative embodiment of the present invention having an alternative, non-planar cutter face;

FIG. 25 is an end view of the cutter illustrated in FIG. 24;

FIG. 26 is an alternative embodiment of the present invention showing an alternative, non-planar cutter face;

FIG. 27 is an end view of the cutter illustrated in FIG. 26;

FIG. 28 is an alternative embodiment of the present invention showing an alternative, non-planar cutter face;

FIG. 29 is an end view of the cutter illustrated in FIG. 28;

FIG. 30 is a pictorial, schematic view of the cutter assembly of FIG. 22 in the process of breaking a chip;

FIG. 31 is an elevated view of one of the cutter faces illustrated in FIGS. 24–29 mounted on a conventional stud body;

FIG. 32 is an alternative embodiment of the present invention illustrating the use of a tungsten carbide button or insert on the gauge diameter of the drill bit; and FIG. 33 is an end view of a tungsten carbide button illustrated in FIG. 32.

DETAILED DESCRIPTION OF THE PREFERRED EMBODIMENT

Figure 1:
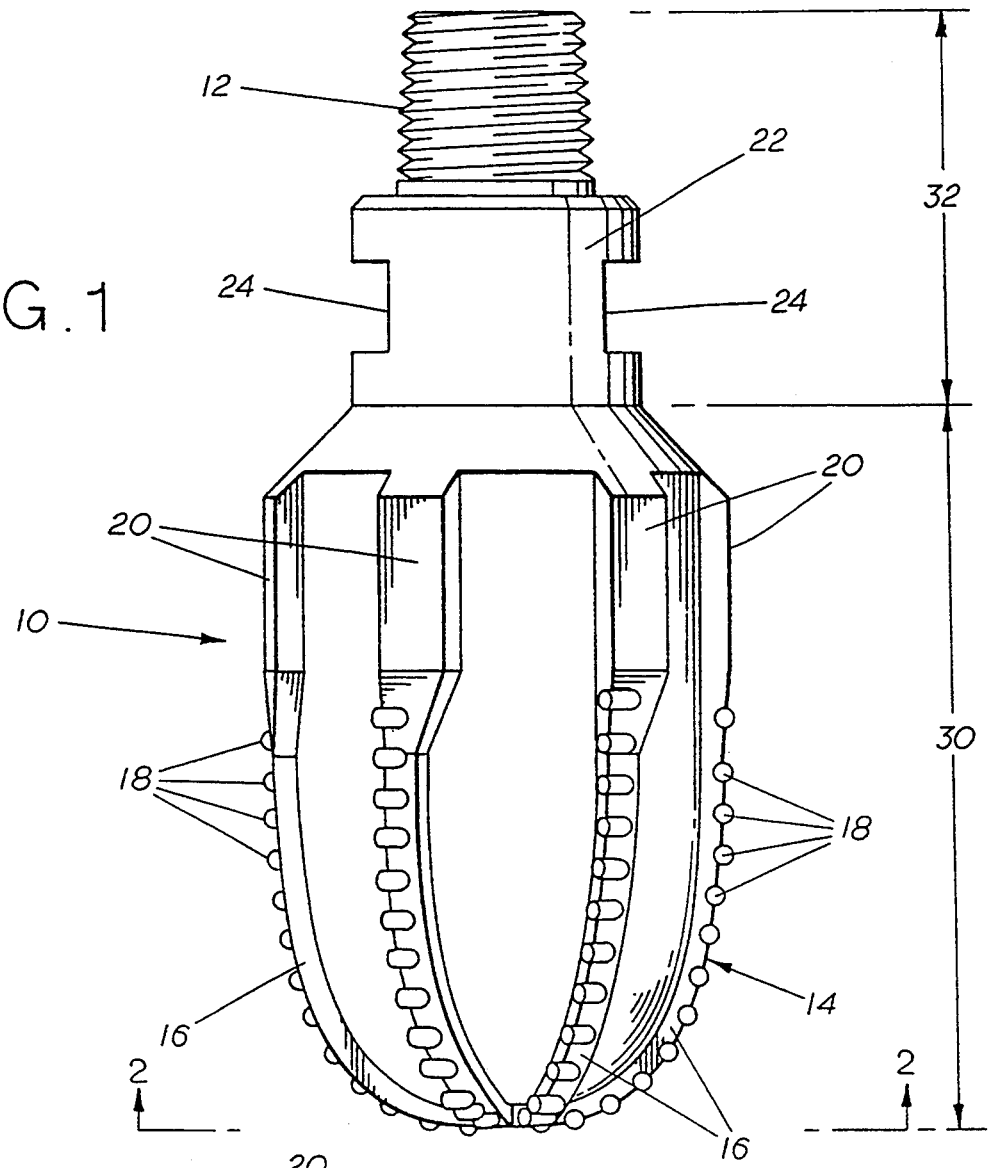
FIG. 1 is an elevated, pictorial view of a drill bit in accordance with the present invention.
Figure 2:
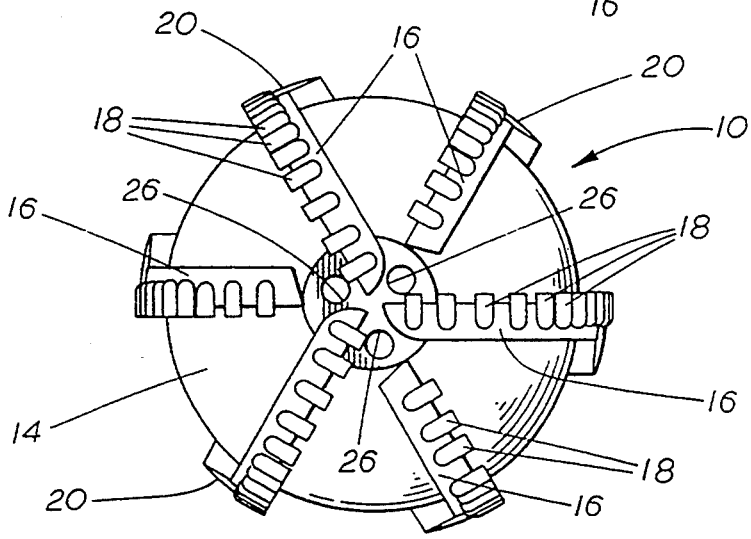
FIG. 2 is an end view of the working face of the drill bit in accordance with FIG. 1.

FIGS. 1 and 2 depict a drill bit of the type in which the present invention may be used. As used herein, "drill bit" will be broadly construed as encompassing both full bore bits and coring bits. Bit body 10, manufactured from steel or another hard metal, has a threaded pin 12 at one end for connection in the drill string, and an operating end face 14 at its opposite end. The "operating end face" as used herein includes not only the axial end or axially facing portion shown in FIG. 2, but also contiguous areas extending up along the lower sides of the bit, i.e., the entire lower portion of the bit that carries the operative cutting members described herein below. More specifically, the operating end face 14 of the bit is transversed by a number of upsets in the form of ribs or blades 16 radiating from the lower central area of the bit and extending across the underside and up along the lower side surfaces of the bit. Ribs 16 carry cutting members 18, to be described more fully below. Just above the upper ends of rib 16, bit 10 has a gauge or stabilizer section, including stabilizer ribs or kickers 20, each of which is continuous with a respective one of the cutter carrying ribs 16. Ribs 20 contact the walls of the borehole that has been drilled by operating end face 14 to centralize and stabilize the bit and to help control its vibration.

Intermediate the stabilizer section defined by ribs 20 and the pin 12 is a shank 22 having wrench flats 24 that may be engaged to make up and break out the bit from the drill string (not illustrated). With reference again to FIG. 2, the underside of the bit body 10 has a number of circulation ports or nozzles 26 located near its centerline, nozzles 26 communicating with the inset areas between rib 16, which areas serve as fluid flow spaces in use.

Figure 3:
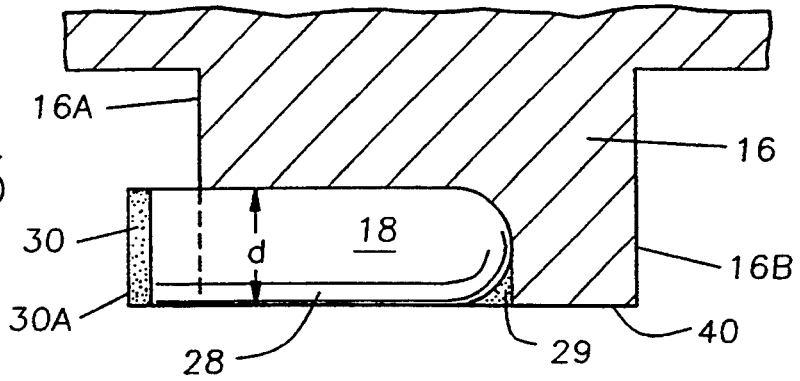
FIG. 3 is an elevated view of a cutting structure brazed in the place within a pocket milled into a rib of the drill bit in accord with FIGS. 1 and 2 of the present invention.

With reference now to FIG. 3 in conjunction with FIGS. 1 and 2, bit body 10 is intended to be rotated in the counter clockwise direction, as viewed in FIG. 2. Thus, each of the ribs 16 has a leading edge surface 16A and a trailing edge surface 16B. As shown in FIG. 3, each of the cutting members 18 is comprised of a mounting body 28 comprised of sintered tungsten earbide or some other suitable material, and a layer 30 of polycrystalline diamond carried on the leading face of the stud 28 and defining the cutting face 30A of the cutting member. The cutting members 18 are mounted in the respective ribs 16 so that their cutting faces are exposed through the leading edge surfaces 16A, respectively. The rib 16 is itself comprised of steel or some other hard metal. The tungsten carbide cutter body 28 is brazed into a pocket 32 (illustrated in FIG. 4) and includes within the pocket the excess braze material 29.

Figure 4:
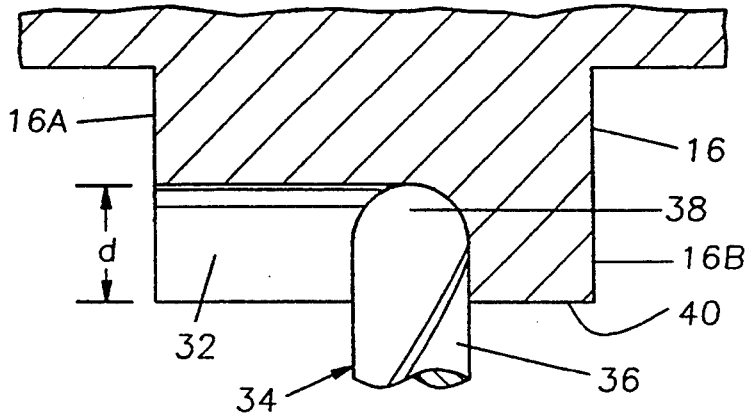
FIG. 4 is an elevated view of a ball nosed end milling tool being used to mill the pocket in the rib illustrated in FIG. 3 in accord with the present invention.

With reference now to FIG. 4, the pocket 32 is milled into the blade 16 through the use of a ball-nosed end mill having a shank 36 and a ball-(spherical-) nosed end 38. In the operation of the ball-nosed end mill 34 illustrated in FIG. 4, the pocket 32 is milled into the blade or upset 16 a depth "d" that in the embodiment of FIGS. 3 and 4 exactly matches the diameter of the stud body 28 illustrated in FIG. 3. By using a ball-nosed end mill, the pocket also has a spherically shaped end that conforms to the spherically shaped end 42 of the stud 18, as illustrated in FIG. 13. Thus, the cutter assembly 18 is placed within the pocket 32 and is brazed therein by brazing techniques well known to those skilled in the art. The addition of the braze material 29 can be used to have the cutter assembly conform completely to the pocket 32 if desired.

Under the assumption that the depth "d" of the pocket 32 exactly matches the diameter of stud body 28, no portion of the cutter extends below the surface 40, thus creating a problem, as those skilled in the art will immediately recognize. While being sound in structure, with the spherical end of the cutter exactly conforming to the end of the pocket, the embodiment of FIG. 3 and 4 cannot be used to cut into the rock formations, since the cutter face 30A preferably extends below the surface 40.

Figure 5:
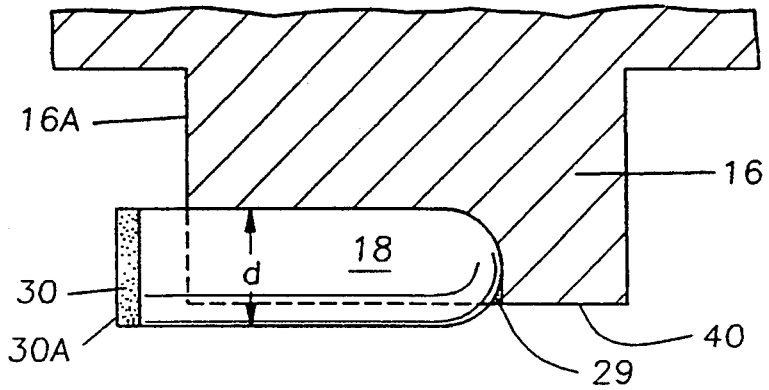
FIG. 5 is an alternative embodiment of the present invention showing a cutting structure brazed into place within a pocket in the rib of a drill bit illustrated in FIGS. 1 and 2 in accord with the present invention.
Figure 6:
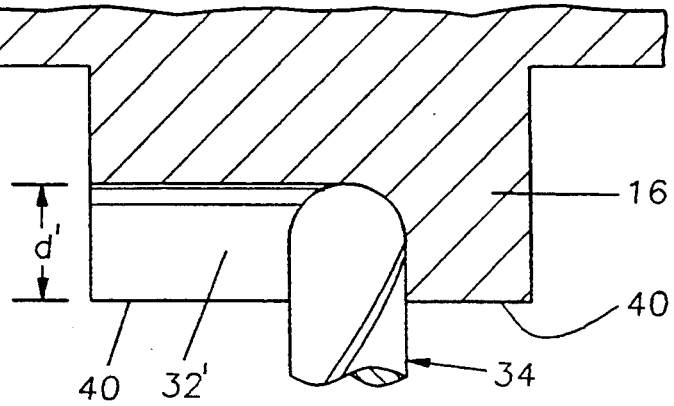
FIG. 6 is an elevated view of an alternative embodiment of a pocket being milled into one of the ribs of the drill bit according to FIGS. 1 and 2 in accord with the present invention.

FIGS. 5 and 6 illustrate a slightly different embodiment in which the ball-nosed end mill 34 is used to mill a pocket 32′ having a depth d′ that is less than the diameter of the stud body 28. Thus, when the cutter assembly 18 is brazed within the pocket 32′, the cutter assembly will protrude slightly below the top surface 40 of the blade 16. As was the case with the embodiment shown in FIGS. 3 and 4, the cutter assembly 18 is brazed into the pocket 32′ and the additional braze material 29 can be used to make a larger portion of the spherical end of the cutter conform to the pocket if desired. It should be appreciated that in each of the embodiments shown in FIGS. 3–6, the ball-nosed end mill allows the pocket 32 or 32′ to be milled into the top surface 40 of the upset 16, commencing at the leading edge surface 16A.

Figure 7:
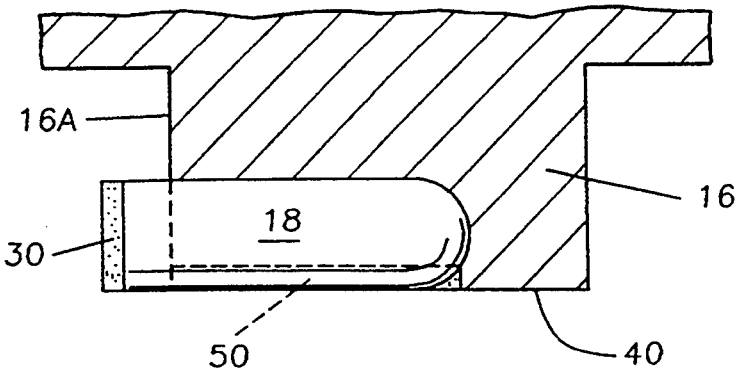
FIG. 7 is an alternative embodiment of a cutting structure brazed into place of a pocket within one of the ribs of the drill bit illustrated in FIGS. 1 and 2 in accord with the present invention.
Figure 8:
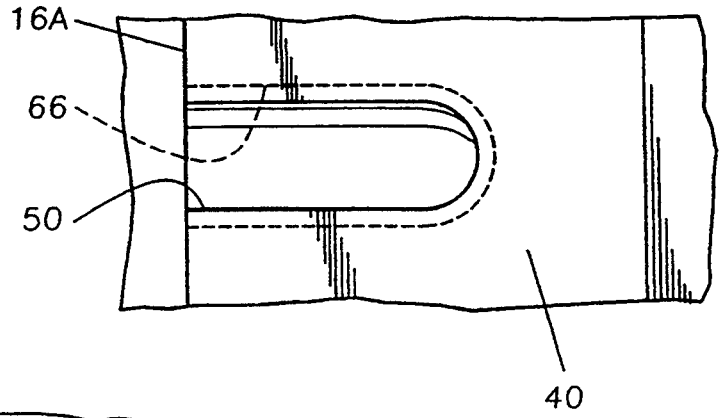
FIG. 8 is a top plan view of a slot milled into the top surface of the rib illustrated in FIG. 7.
Figure 9:
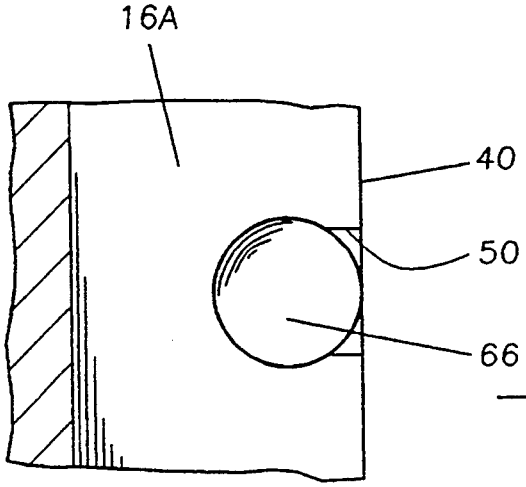
FIG. 9 is an end view of the slot illustrated in FIG. 8.
Figure 10:
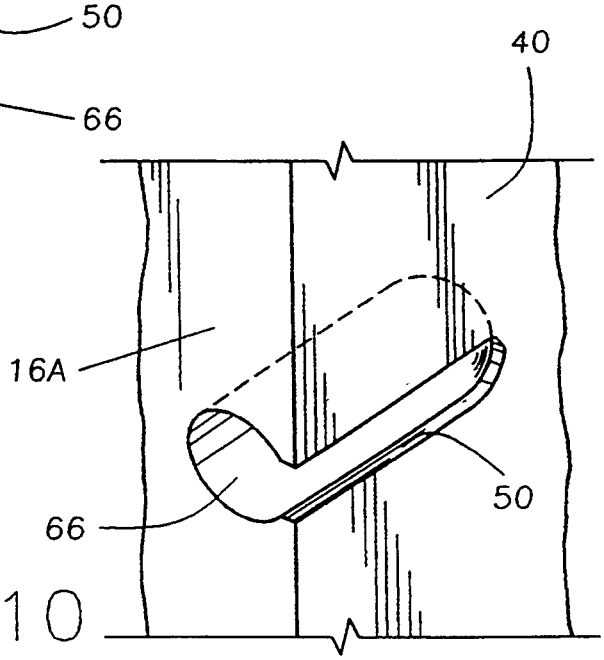
FIG. 10 is a pictorial view of the slot and the pocket milled into the rib illustrated in FIGS. 7–9.

FIGS. 7–10 illustrate an alternative embodiment of the present invention. A first slot 50 is milled into and parallel 20 the top surface 40 having a length that is slightly shorter than the length of the cutting structure 18 and having a width slightly smaller than the diameter of the cylindrical portion 28 of the cutting structure. In the preferred embodiment, the one end of the slot 50 is semicircular-shaped as illustrated in FIG. 8, but the slot can be squared off or have another shape if desired. After the slot 50 is milled into the surface 40, a reduced shank diameter ball-nosed end mill 60 (FIG. 12) is used to mill a pocket 66 into the leading face 16A. The shank 62 is reduced in diameter from that of the normal shank diameter illustrated in FIG. 11 and is sized such as to pass through the slot 50 in milling the pocket 66. As was the case with respect to FIGS. 3–6, the end result is a pocket 66 that conforms to the shape of the cutting structure 18 illustrated in FIG. 13.

Thus, whereas the cutting structure 18 is only partially conformed to the spherical end of the pocket 32 or pocket 32′ illustrated in FIGS. 5 and 6, the cutting structure 18 is substantially conformed to the spherical end of the pocket 66 illustrated in FIG. 7–10. As is illustrated and described with respect to FIGS. 3–6, the cutter assembly 18 illustrated with respect to FIGS. 7–10 is brazed into the pocket 66.

Figure 15:
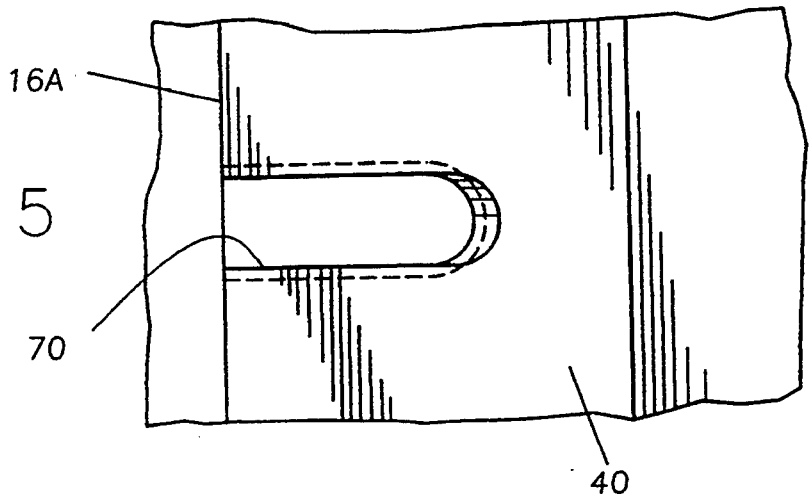
FIG. 15 is a top plan view of the slot milled into the top surface of the rib illustrated in FIG. 14.

However, the embodiment illustrated in FIGS. 7–10 has a problem similar to the problem discussed about with respect to FIGS. 3 and 4, viz., that of the cutter face 30A not extending below the surface 40. FIGS. 14 and 15 illustrate an alternative embodiment that alleviates that problem.

For example, in FIG. 14, instead of milling the slot 70 parallel to the surface 40 (as illustrated in FIG. 7), the slot 70 is milled having a bottom surface 72 commencing at the intersection of surfaces 16A and 40 and angles up to the point 74. FIG. 15 shows a top plan view of the surface 40 having the slot 70 milled therein. The reduced shank end mill illustrated in FIG. 12 is then used to mill out the pocket 76 into which the bullet-shaped cutter 18 is brazed, with the spherical end 42 of the cutter conforming to the spherical end of pocket 76. The slot 70 is preferably filled with braze material to fill out the surface 40.

Figure 16:
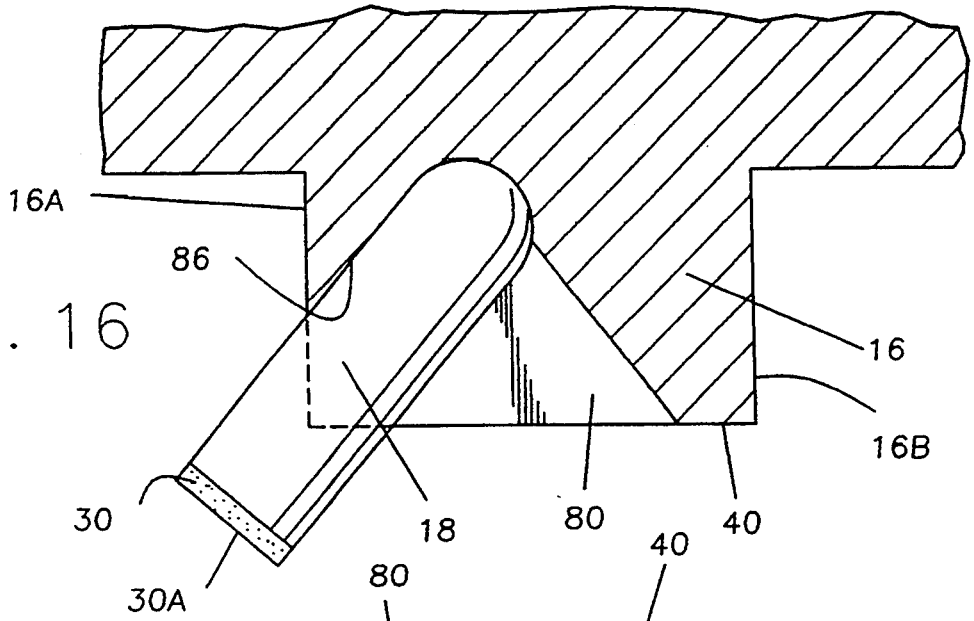
FIG. 16 is an alternative embodiment of a cutter brazed into place within a pocket in a rib of the drill bit illustrated in FIGS. 1 and 2 but having a steeper angle away from the top surface of the rib.
Figure 17:
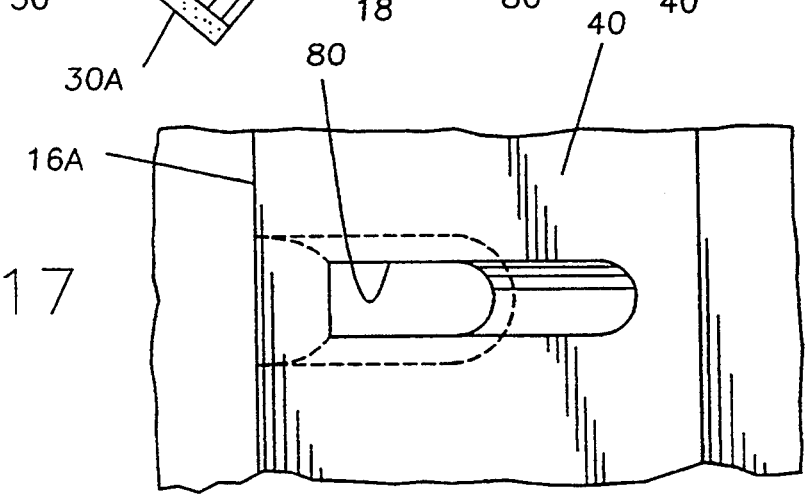
FIG. 17 is a top plan view of the slot milled into the top surface 40 of the embodiment of FIG. 16.

FIG. 16 illustrates a slightly different embodiment in which the slot 80 is milled at an increased angle over that illustrated in FIG. 14 and commences in the surface 40 removed from its intersection with surface 16A. FIG. 17 shows a top plan view of the surface 40 having the slot 80 milled therein. The reduced shank end mill illustrated in FIG. 12 is then used to mill out the pocket 86, into which the cutter 18 is brazed. The slot 80 is filled with braze material.

It should be appreciated that in both of the embodiments of FIGS. 14 and 15, the cutting face 30A extends below the surface 40.

Figure 18:
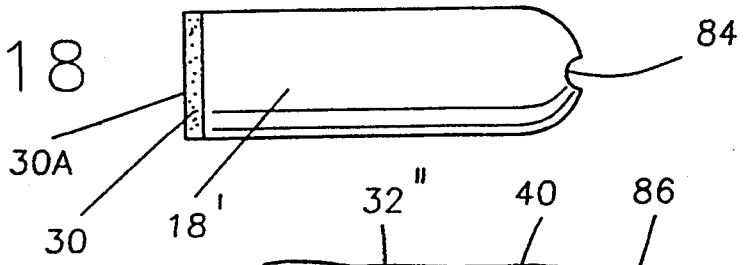
FIG. 18 is a pictorial representation of an alternative embodiment of the cutter assembly having a receptacle at its spherical shaped end to receive a pin illustrated in FIG. 20.
Figure 20:
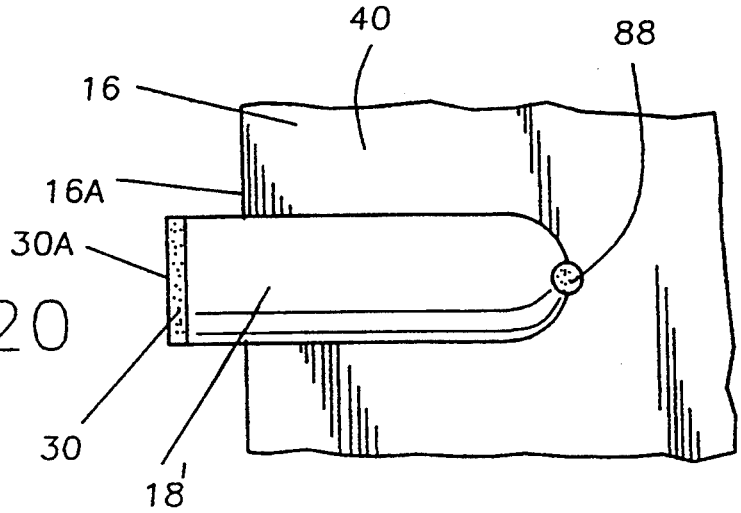
FIG. 20 is a top plan view of the cutter assembly illustrated in FIG. 18 brazed into place within the pocket illustrated in FIG. 19 and having a pin brazed therein to anchor the, cutter assembly into the pocket.
Figure 21:
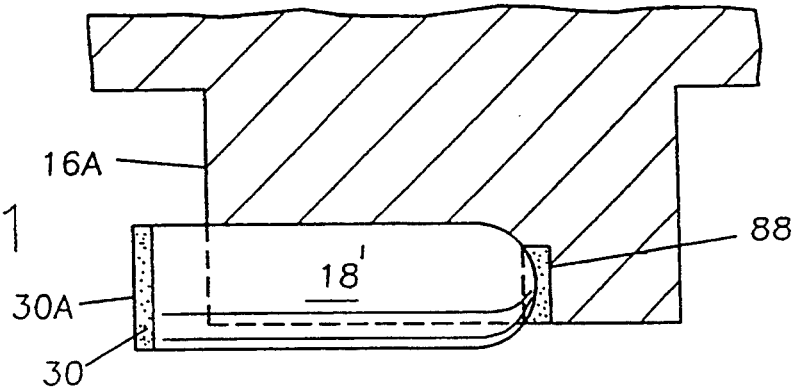
FIG. 21 is an elevated view of the cutter assembly of FIG. 18 brazed into place within the pocket illustrated in FIG. 19 and having the pin brazed therein to anchor the cutter assembly into the pocket.

With reference now to FIG. 18, a second embodiment of the bullet-shaped cutter 18′ is illustrated as having a semicircular receptacle 84 that is configured to receive the pin 88 illustrated in FIG. 20.

Figure 19:
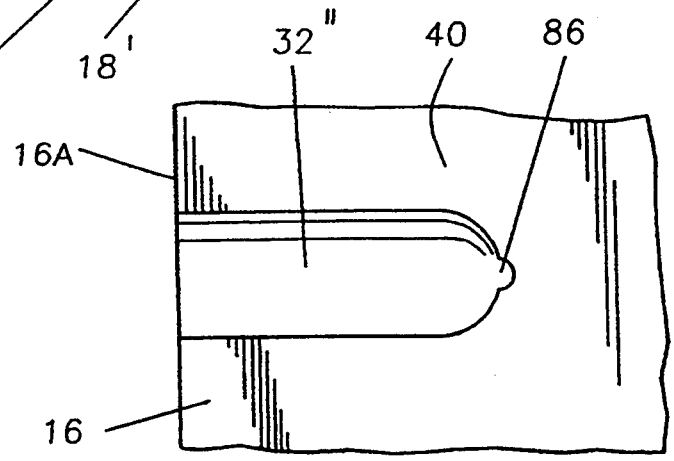
FIG. 19 is a pictorial representation of a pocket having a receptacle at its spherical shaped end to also receive the pin illustrated in FIG. 20.

FIG. 19 illustrates a different embodiment of the pocket 32″ shown as having a semicircular receptacle 86 configured into the spherical end of the pocket 32″.

FIG. 20 shows an elevated view of the cutter 18′ brazed into place in the pocket 32″ and also having the pin 88 brazed into place to anchor the cutter 18′ within the pocket 32″.

It should be appreciated that the cutter and pocket assembly illustrated in FIGS. 18–21 is intended to remedy a potential problem associated with the embodiment of FIG. 5. In viewing the embodiment of FIG. 5, it will be immediately recognized that as the cutter face 30A cuts into the earth's formations, there will be a tendency for the cutter 18 to be pushed out of the pocket 32′ illustrated in FIG. 6. By brazing the pin 88 of FIG. 21 into the matching receptacles 84 and 86 during the assembly process, the cutter 18′ will be anchored into the pocket 32″ to prevent the cutter from being pushed up out of the pocket. The receptacles 84 and 86 and the pin 88 can also be used to provide orientation of the cutter 18′ in the pocket 32″ such as, for example, whenever the cutter 18′ has one of its sides flattened, either intentionally or unintentionally, or in the case of the cutter face 30 having a specific orientation such as, for example, whenever CLAW cutters are used in bits manufactured by DB Stratabit, Inc., a sister company of Baroid Technology, Inc., the Assignee of the present application.

With reference now to FIG. 22 and 23, there is illustrated a bullet-shaped cutter 101 having a spherical end 102 and a cutter assembly 103 and 104 that comprises a carrier body 103 of tungsten carbide and a PDC cutter face 104 that has a V-shaped groove 105 across its face. The groove may have its median length (the apex of the groove) on the diameter of the cutter face, or may be on another chord if desired.

FIG. 24 and 25 illustrate another bullet-shaped cutter assembly 106 having a spherical first end 107. Its other end has a tungsten carbide carrier 108 and a PDC cutter face 109 having therein a conically shaped orifice 110.

FIG. 26 and 27 illustrate yet another bullet-shaped cutter assembly 111 having a spherical first end 112 and at its other end a tungsten carbide carrier 113 and a PDC cutter face 114. A center hole 115 extends through the cutter face 114 and also extends into the tungsten carbide carrier 113.

FIG. 28 and 29 illustrate yet another bullet-shaped cutter assembly 116 having a spherical first end 117 and having at its second end a tungsten carbide carder 118 and a PDC cutter face 119. A center hole 120 extends completely through the PDC cutter face 119 and also extends into the tungsten carbide carrier 118. A layer of PDC material 121 surrounds the center hole 120.

FIG. 30 illustrates the utility of the chip-breaker cutter assemblies illustrated in FIGS. 22–29. For example, the cutter assembly 101 illustrated in FIG. 22 is brazed into a pocket in a rib 16 in the same manner as was illustrated in FIG. 5. As the cutter assembly 101 cuts into the earth formation 125, it is common practice that small slivers or chips 126 are generated. Since it is desirable to break the chips off, the cutter face 104 having the V-shaped indentation 105 causes the chip 126 to break off. In a similar manner, the embodiments illustrated in FIGS. 22–29 will cause the chips from the formation to enter the orifices 110, 115 or 120 and thus be broken off.

FIG. 31 illustrates a cutter assembly, for example, the cutter assembly 106 illustrated in FIG. 24, which demonstrates that the chip breaker cutter faces and their underlying tungsten carbide carriers can be mounted on a conventional stud assembly as an alternative to the embodiments illustrated hereinbefore in which they are mounted on the bullet-shaped cutter assemblies.

FIG. 32 and 33 illustrate an alternative embodiment of the present invention in which each of the stabilizer ribs or kickers 20 of FIGS. 1 and 2 is modified to include a tungsten carbide button or insert 132 above the gauge cutter assembly 134. The tungsten carbide button is at the gauge diameter and is positioned to be at exactly the same diameter as the cutting face 134A. It should be appreciated that each of the stabilizers 20 has such a tungsten carbide button 132 placed thereon at the gauge diameter.

As a conventional PDC drill bit rotates, it tends to dig into the side of the borehole. This phenomenon reinforces itself on subsequent passes of the bit. Progressively, a non-uniformity is generated in the borehole wall, causing an impact on the gauge cutter in response to the wobble of the bit. Thus, because PDC bits tend to make the borehole slightly larger than the gauge diameter of the bit, often times causing the bit to wobble as it rotates, the stabilizer ribs 20 are otherwise exposed to high impact forces that can also damage the cutter assemblies such as the cutter assembly 134. To minimize this impact upon the cutter assemblies and the bit, the tungsten carbide button, being at the gage diameter, protrudes laterally just ahead of the outer cutting elements. The protrusion takes the impact, instead of the cutter, and thus protects the cutter structure. The button 132 can be manufactured from tungsten carbide or any other hard metal material, or it can be steel coated with another hard material or the like. The present invention overcomes this problem by positioning the tungsten carbide insert on the stabilizer rib to take the impact that would have otherwise been inflicted on the cutter assembly.

What is claimed is:

1. A cutting structure for use in a drag bit, comprising:

a tungsten carbide carrier body for mounting in said drag bit;

a polycrystalline diamond compact layer mounted on said carrier, said layer having an outer periphery that completely surrounds an interior portion of said layer, said layer having a receptacle within said interior portion of said layer for breaking chips during the drilling operation, said receptacle being completely encircled by said interior portion. Of said layer, said receptacle extending at least completely through said layer and terminating with said tungsten carbide carrier body.

2. A cutting structure for use in a drag bit, comprising:

a tungsten carbide carrier body for mounting in said drag bit;

a polycrystalline diamond compact layer mounted on said carrier, said polycrystalline diamond compact layer having a receptacle for breaking chips during the drilling operation, said receptacle being cylindrical and extending at least completely through said polycrystalline diamond compact layer and terminating with said tungsten carbide carrier body.

3. A cutting structure for use in a drag bit comprising:

a tungsten carbide carrier body for mounting in said drag bit;

a polycrystalline diamond compact first layer mounted on said carrier, said first layer having a receptacle therein for breaking chips during a drilling operation, a second layer of polycrystalline diamond compact material, said receptacle being at least partially lined with said second layer of polycrystalline diamond compact material.

4. The cutting structure according to claim 3, wherein said receptacle is conical shaped.

5. The cutting structure according to claim 3, wherein said receptacle is cylindrical.

* * * * *

UNITED STATES PATENT AND TRADEMARK OFFICE

CERTIFICATE OF CORRECTION

PATENT NO. : 5,449,048

DATED : September 12, 1995

INVENTOR(S) : Thigpen et al.

It is certified that error appears in the above-indentified patent and that said Letters Patent is hereby corrected as shown below:

In column 8, line 7, delete ". Of" after "portion".

In column 8, line 8, delete "said layer" before "said receptacle".

Signed and Sealed this

Eleventh Day of June, 1996

*Attest:*

BRUCE LEHMAN

*Attesting Officer*

*Commissioner of Patents and Trademarks*